US007886989B2

(12) United States Patent
Saidman et al.

(10) Patent No.: US 7,886,989 B2
(45) Date of Patent: Feb. 15, 2011

(54) LIQUID MATERIAL DISPENSING APPARATUS AND METHOD UTILIZING PULSED PRESSURIZED AIR

(75) Inventors: Laurence B. Saidman, Duluth, GA (US); Reuben F. Brock, Suwanee, GA (US)

(73) Assignee: Nordson Corporation, Westlake, OH (US)

( * ) Notice: Subject to any disclaimer, the term of this patent is extended or adjusted under 35 U.S.C. 154(b) by 858 days.

(21) Appl. No.: 10/700,612

(22) Filed: Nov. 4, 2003

(65) Prior Publication Data

US 2005/0092775 A1 May 5, 2005

(51) Int. Cl.
*A62C 5/02* (2006.01)

(52) U.S. Cl. ..... 239/8; 239/290; 239/296; 239/298; 239/101; 239/433; 239/135; 239/424; 239/566; 118/300; 118/302; 427/208.6; 427/427.2; 222/146.2

(58) Field of Classification Search ..... 239/290, 239/291, 296, 298, 101, 418, 433, 128, 135, 239/566, 423, 424, 8, 11; 118/300, 302, 118/313; 427/208.6, 421.1, 427.2, 427.3; 222/146.2, 146.5
See application file for complete search history.

(56) References Cited

U.S. PATENT DOCUMENTS 4,957,783 A * 9/1990 Gabryszewski ..... 239/101
4,995,333 A * 2/1991 Keller et al. ..... 118/300
5,322,706 A * 6/1994 Merkel et al. ..... 427/427.2
5,540,804 A 7/1996 Raterman
5,740,963 A * 4/1998 Riney et al. ..... 239/433
5,800,867 A * 9/1998 Matsunaga et al. ..... 427/476
6,325,853 B1 * 12/2001 Hogan et al. ..... 118/300
6,814,310 B2 * 11/2004 Boger ..... 239/596
6,911,232 B2 * 6/2005 Crane et al. ..... 427/208.6
7,617,951 B2 * 11/2009 Saidman et al. ..... 222/146.5

FOREIGN PATENT DOCUMENTS

WO WO99/54057 * 10/1999

OTHER PUBLICATIONS

Rajiv S. Rao et al. *Vibration and Stability in the Melt Blowing Process*, Ind. Eng. Chem., 32 pgs., 3100-3111, 1993.

* cited by examiner

*Primary Examiner*—Steven J Ganey
(74) *Attorney, Agent, or Firm*—Wood, Herron & Evans, L.L.P.

(57) ABSTRACT

An apparatus for dispensing liquid material includes a dispensing module having a liquid supply passage communicating with a supply of liquid material and an air supply passage communicating with a source of pressurized air. A nozzle is coupled to the dispensing module and has a liquid discharge passage and an air discharge passage communicating with the liquid supply passage and the air supply passage, respectively. The liquid material is dispensed from a liquid discharge outlet of the nozzle and pressurized air is directed from an air outlet of the nozzle toward the dispensed liquid material. An air valve coupled to the nozzle is operable to vary the pressure of the air discharged from the air outlet to thereby move the liquid material in a desired pattern. In an exemplary embodiment, the valve is operable to pulse the pressurized air.

12 Claims, 3 Drawing Sheets

LIQUID MATERIAL DISPENSING APPARATUS AND METHOD UTILIZING PULSED PRESSURIZED AIR

FIELD OF THE INVENTION

The present invention relates generally to material dispensing systems for applying liquid material onto a moving substrate, and more particularly to a material dispensing system utilizing pressurized air to control the pattern of material dispensed to a moving substrate.

BACKGROUND OF THE INVENTION

Various dispensing systems have been used in the past for applying patterns of viscous material onto a moving substrate. In the production of disposable diapers, incontinence pads and similar articles, for example, hot melt adhesive dispensing systems have been developed for applying a laminating or bonding layer of hot melt thermoplastic adhesive between a non-woven fibrous layer and a thin polyethylene backsheet. Typically, the hot melt adhesive dispensing system is mounted above a moving polyethylene backsheet layer and applies a uniform pattern of hot melt adhesive material across the width of the backsheet substrate. Downstream from the dispensing system, a non-woven layer is laminated to the polyethylene layer through a pressure nip and then further processed into a final product.

In one known hot melt adhesive dispensing system, continuous beads or filaments of adhesive are emitted from a multiple adhesive outlet die with multiple air jets oriented around the circumference of each material outlet. The multiple air jets are tangentially directed relative to the orientation of the adhesive filament as it emits from the die orifice, thereby attenuating each adhesive filament and causing the filaments to swirl before being deposited on the upper surface of the moving substrate.

More recently, manufacturers of diaper products and others have been interested in small fiber technology for the bonding layer of hot melt adhesive in non-woven and polyethylene sheet laminates. To this end, hot melt adhesive dispensing systems have incorporated slot nozzle dies with a pair of angled air channels formed on either side of the elongated extrusion slot of the die. As the hot melt adhesive emits from the extrusion slot as a continuous sheet or curtain, pressurized air is emitted as a pair of curtains from the air channels to impinge upon, attenuate and fiberize the adhesive curtain to form a uniform fibrous web of adhesive on the substrate. Recently, fibrous web adhesive dispensers have incorporated intermittent control of adhesive and air flows to form discrete patterns of fibrous adhesive layers with well defined cut-on and cut-off edges and well defined side edges.

Meltblown technology has also been adapted for use in this area to produce a hot melt adhesive bonding layer having fibers of relatively small diameter. Meltblown dies typically include a series of closely spaced orifices in one or more dies or nozzles that are aligned on a common axis across the die head. An angled air channel is provided on each side of the orifices. As hot melt adhesive emits from the series of aligned nozzles, pressurized air is emitted from the air channels as a pair of curtains that impinge upon, draw down and attenuate the fibers before they are applied to the moving substrate.

While these prior systems have been used to produce fibrous adhesive layers on moving substrates, it is still desired to continue to improve the controllability of the dispensed liquid material patterns, in particular, the frequency of oscillation of the dispensed liquid material.

SUMMARY OF THE INVENTION

The present invention provides a dispensing system in which pressurized air is varied to control the movement of a liquid material stream dispensed from a liquid discharge outlet. The system comprises a dispensing module coupled to a supply of liquid material and a source of pressurized air. A nozzle or die coupled to the module receives liquid material and pressurized air though the module and dispenses the liquid material through a liquid discharge outlet. An air outlet proximate the liquid discharge outlet directs the pressurized air toward the dispensed liquid material to attenuate and deflect the liquid material. Advantageously, the pressure of the air is varied as the liquid discharge is maintained to cause the liquid material to move in a desired pattern as it is dispensed from the liquid discharge outlet.

The dispensing system further comprises a valve coupled to the nozzle and operable to vary the pressurized air discharged from the air outlet. In one embodiment, the valve is operable to rapidly pulse the air to thereby move the liquid material in a desired generally oscillating pattern. More specifically, the valve can pulse the air at a rate of approximately 500 to 2000 cycles per second. The valve may be operated between open and closed positions to vary the pressure of the air. Alternatively, it may be operated to and between the open position, the closed position, and at least one position intermediate the open and closed positions, whereby the air may be pulsed by the valve to vary the pressure above and below an intermediate pressure.

In another embodiment, the nozzle has first and second liquid discharge outlets for dispensing liquid material therefrom. An air outlet is positioned between the first and second liquid discharge outlets. Pressurized air discharges from the air outlet toward the liquid material dispensed from both liquid discharge outlets. Advantageously, the valve is operable to vary the pressurized air from the air outlet, whereby both streams of liquid material may be moved by the pressurized air to create desired patterns of liquid material on a substrate.

A method according to this invention can include dispensing liquid material from a liquid discharge outlet, directing a stream of pressurized air toward the dispensed liquid material, and varying the pressure of the pressurized air while discharging the liquid material to thereby move the dispensed liquid material in a desired pattern.

These and other features, advantages, and objectives of the invention will become more readily apparent to those of ordinary skill in the art upon review of the following detailed description of the exemplary embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
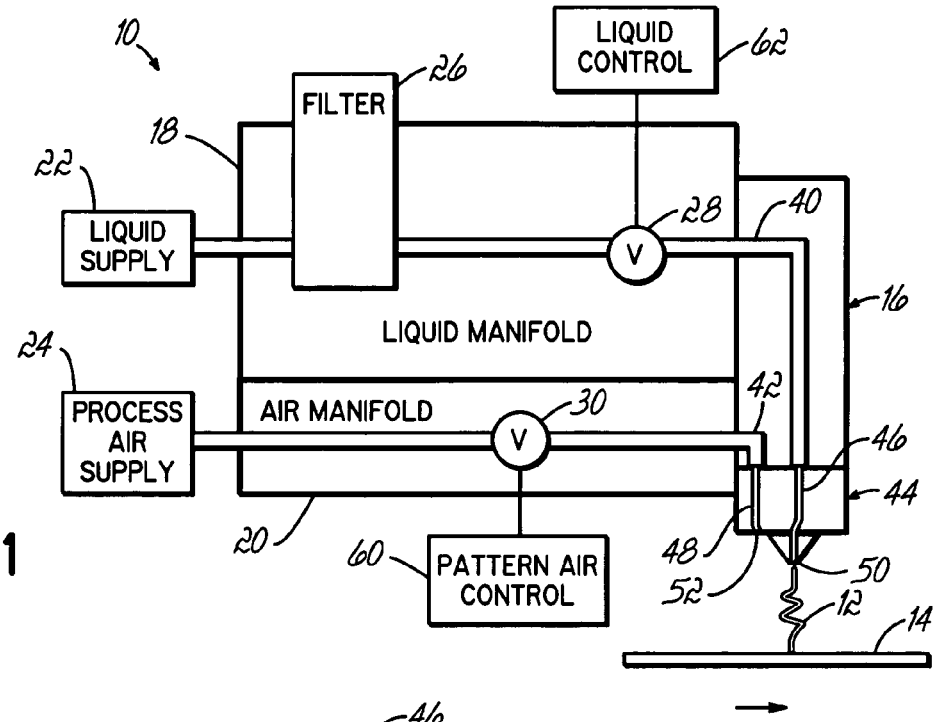
FIG. 1 is a schematic illustration of a liquid dispensing system according to the present invention.

Referring to FIG. 1, there is shown an exemplary dispensing system 10 for dispensing liquid material 12 to a moving substrate 14. The system 10 includes a dispensing module 16 coupled to a liquid material manifold 18 and a process air manifold 20 for receiving liquid material and process air from a liquid material supply 22 and a process air supply 24. The liquid material manifold 18 may be provided with a filter 26 for filtering out contaminates or other unwanted debris from the liquid. The liquid manifold 18 and air manifold 20 may also be heated, as known in the art, to maintain the liquid material 12 and process air at desired temperatures, and to maintain the liquid material 12 at a desired viscosity until dispensed onto the substrate 14. The dispensing system 10 further includes a controllable valve 28 disposed between the liquid material supply 22 and the dispensing module 16 to control the flow of liquid material 12 as desired. In the embodiment shown, the dispensing system 10 further includes an air valve 30 disposed between the process air supply 24 and the dispensing module 16 for controlling the pressurized air provided to the module 16.

Figure 2:
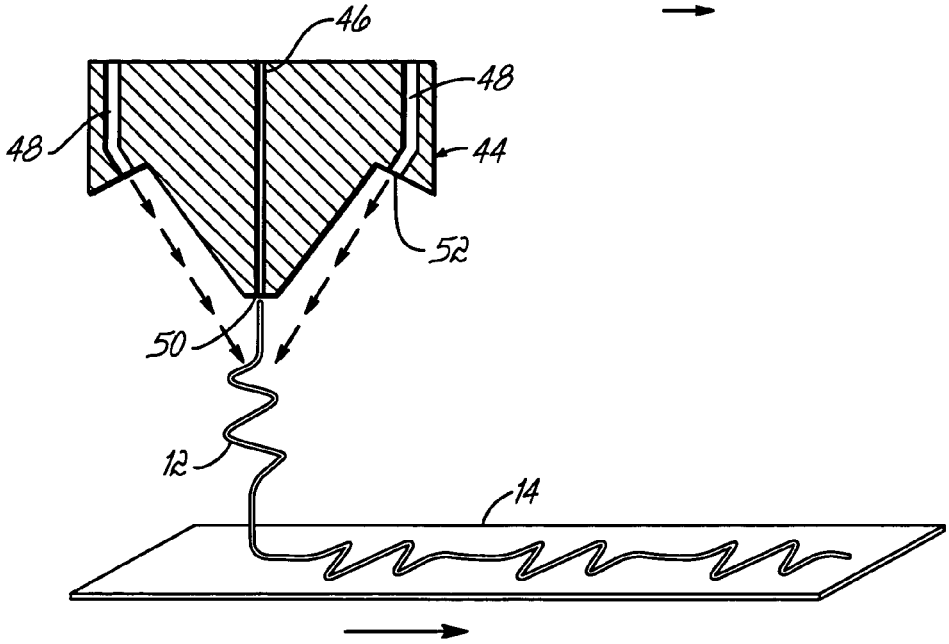
FIG. 2 is a is an enlarged view of system of FIG. 1, depicting liquid material being dispensed to a substrate according to the present invention.

Referring to FIGS. 1 and 2, the dispensing module 16 is couplable to the liquid manifold 18 and the air manifold 20, and has a liquid supply passage 40 in communication with the liquid supply 22, and an air supply passage 42 in communication with the process air supply 24. The dispensing module 16 is configured to receive and support a nozzle 44 for dispensing the liquid material 12 therefrom. Accordingly, the nozzle 44 includes a liquid discharge passage 46 in fluid communication with the liquid supply passage 40 of the dispensing module 16, and an air discharge passage 48 in fluid communication with the air supply passage 42 of the module 16.

Figure 3A:
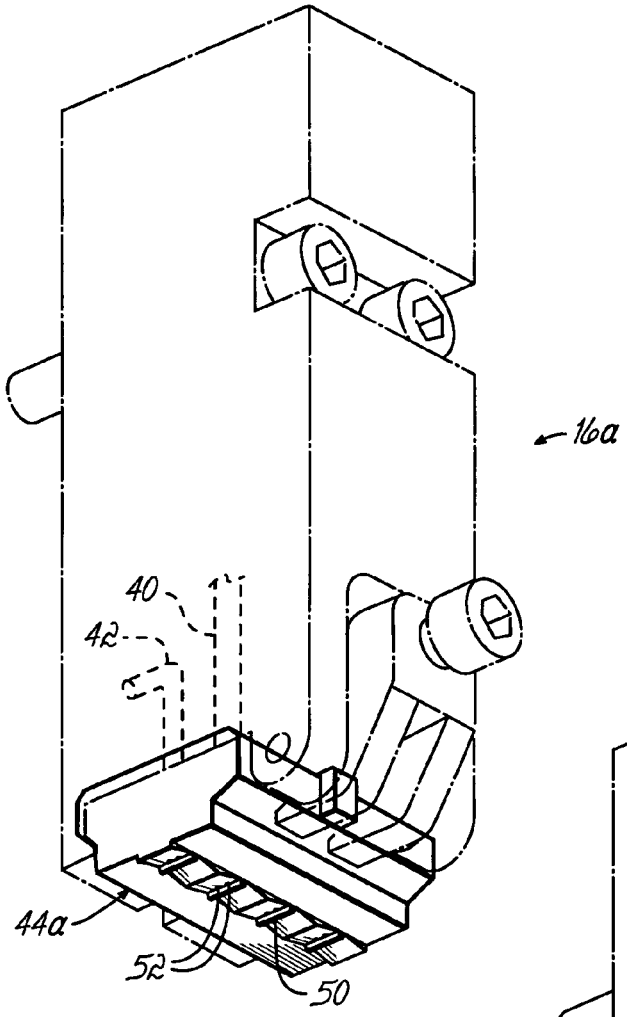
FIG. 3A is a perspective view of an exemplary dispensing module, according to the present invention.
Figure 3B:
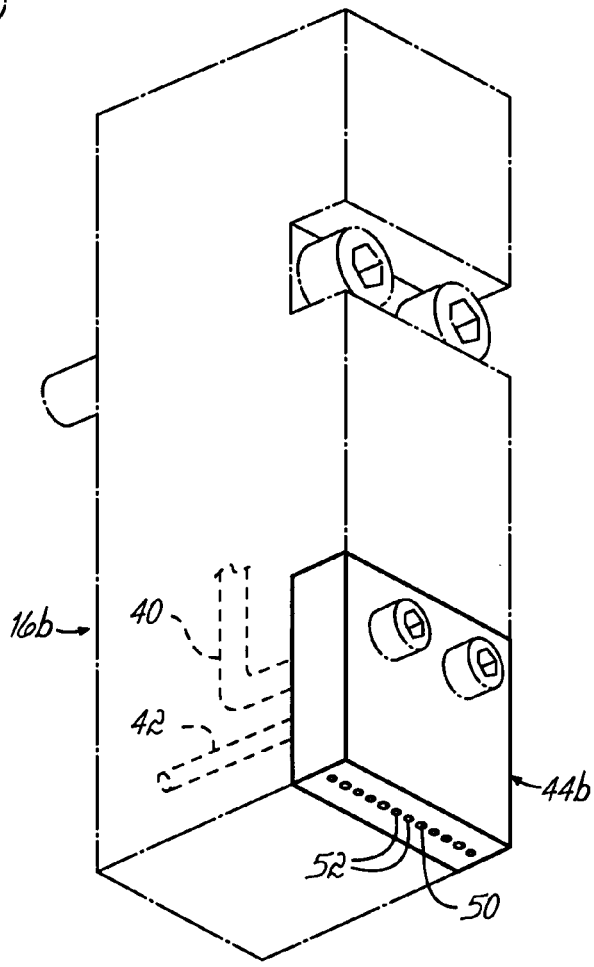
FIG. 3B is a perspective view of another exemplary dispensing module according to the present invention.

The nozzle 44 further includes a liquid discharge outlet 50 for dispensing the liquid material 12 to the substrate 14. The air discharge passage 48 has an air outlet 52 proximate the liquid discharge outlet 50 whereby the air discharged from the air outlet 52 is directed toward the liquid material 12 dispensed from the liquid discharge outlet 50, as depicted most clearly in FIG. 2. As the air impinges the dispensed liquid material 12, the stream of liquid material 12 is displaced to create patterns of liquid material 12 on the moving substrate 14, as known in the art and illustrated in FIG. 2. FIG. 3A depicts an exemplary module 16*a* which receives a nozzle 44*a* coupled to a bottom surface of the module 16*a*. FIG. 3B depicts another exemplary module 16*b* configured to receive a nozzle 44*b* coupled to a side surface of the module 16*b*. It will be recognized, however, that module 16 and nozzle 44 may have other configurations for dispensing liquid material 12 to a substrate 14, as known in the art.

Similarly, the liquid discharge outlet 50 and air outlet 52 of nozzle 44 may be provided in a variety of arrangements and configurations to produce various desired patterns of dispensed liquid material 12, such as oscillating patterns or swirl patterns, as known in the art. For example, a nozzle 44 may have a single liquid discharge outlet 50 and a single air outlet 52, or one or more liquid discharge outlets 50 may be associated with one or more air outlets 52 to create the desired pattern of dispensed liquid material 12.

Figure 4A:
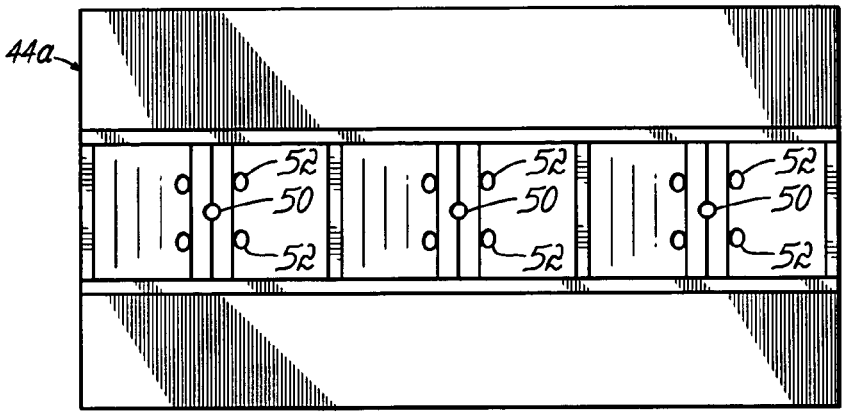
FIG. 4A is a bottom view of an exemplary nozzle used on the exemplary module of FIG. 3A.
Figure 4B:
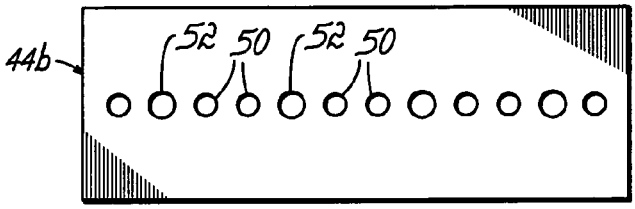
FIG. 4B is a bottom view of an exemplary nozzle used on the exemplary module of FIG. 3B.

FIG. 4A depicts an exemplary nozzle 44*a* wherein each of a plurality of liquid discharge outlets 50 is associated with multiple air outlets 52. In this configuration, pressurized air discharged from the multiple air outlets 52 associated with each liquid discharge outlet 50 attenuates and deflects the liquid material 12 dispensed from the liquid discharge outlet 50 to create a desired pattern on substrate 14. FIG. 4B depicts another embodiment wherein a plurality of liquid discharge outlets 50 and air outlets 52 are arranged in a linear fashion with each air outlet 52 associated with two liquid discharge outlets 50, one on either side of the air outlets 52. In this configuration, pressurized air from each air outlet 52 attenuates and deflects liquid material 12 dispensed from each of the liquid discharge outlets 50 disposed on opposite sides of the air outlet 52.

In the embodiment shown, the air valve 30 is operable to rapidly vary the pressurized air discharged from the air outlet 52 to thereby move the stream of liquid material 12 dispensed from the liquid discharge outlet 50 in a desired pattern. In this regard, the air valve 30 may be operated between open and closed positions to create rapid pulses of pressurized air, or the air valve 30 may be operated to and between and open position, a closed position, and at least one position intermediate the open and closed positions of the air valve 30 to thereby vary the pressure of the air in a pulsed manner such that the pressure of the air varies about an intermediate pressure. In one embodiment, the air valve 30 is used to vary the air pressure between about zero psi and 40 psi. In another embodiment, the air valve 30 is used to vary the air pressure by as much as about 30 psi. In yet another embodiment, the air valve 30 is configured to pulse the air at a rate of approximately 500 cycles per second to approximately 2000 cycles per second. Preferably, the liquid discharge outlets 50 and air outlets 52 have diameters in the range of about 0.008" to about 0.030". The flow rate of the liquid can be about 10 grams/min./stream at a viscosity of between about 1,000 cps to about 10,000 cps. The air can be set to a pressure between about 5 psi to about 15 psi at a flow rate of about 0.1 cfm to about 2.0 cfm.

In the embodiment shown, the air valve 30 is a solenoid valve and is actuated by a controller 60 configured to operate the valve 30 such that a desired pressure is provided to the dispensed liquid material 12 at a desired pulse frequency to thereby create a desired pattern on the moving substrate 14. The controller 60 for the air valve 30 may be independent or may be combined with a control unit 62 which actuates the liquid valve 28.

Figure 5:
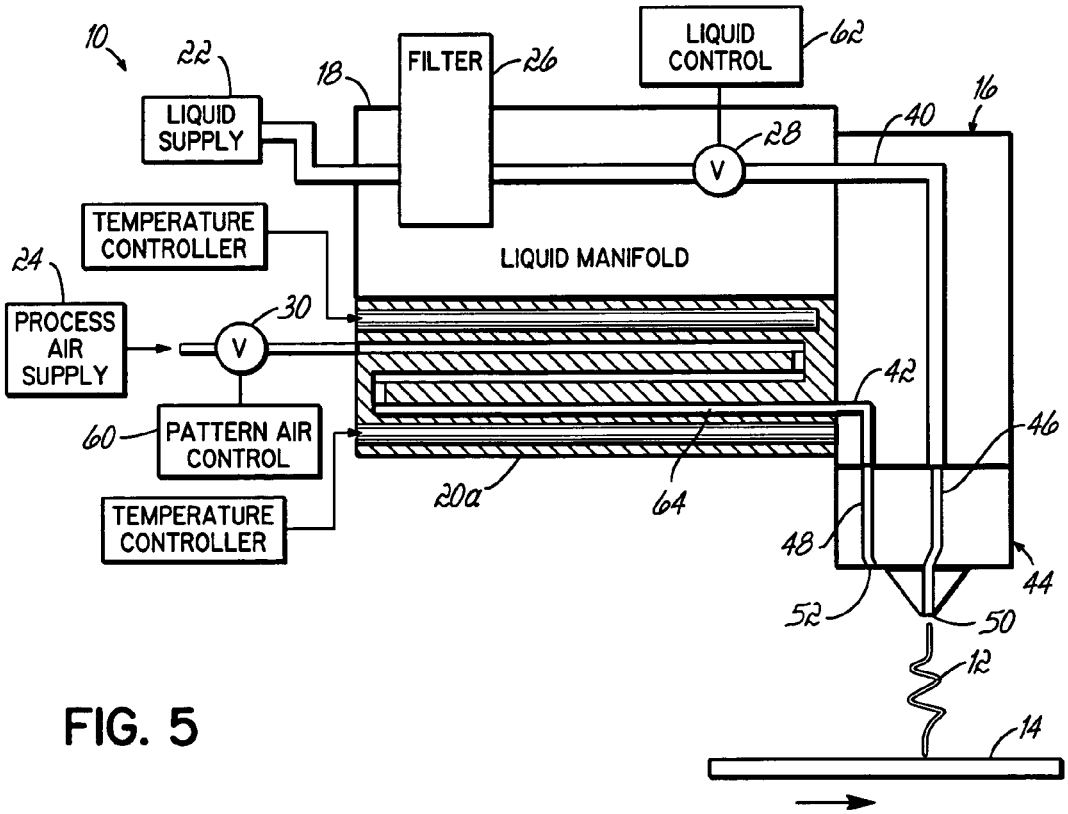
FIG. 5 is a schematic illustration depicting another exemplary embodiment of a liquid dispensing system according to the present invention.

In the exemplary embodiment shown in FIG. 1, the air valve 30 is positioned within the air manifold 20, adjacent to the nozzle 44, to minimize the distance between the air valve 30 and the nozzle 44 such that more robust control of the pulsed air may be maintained. Alternatively, the air valve 30 may be provided between the process air supply 24 and the air manifold 20, as shown in the embodiment of FIG. 5, wherein components similar to those described above have been similarly numbered. In this embodiment, the air manifold 20*a* comprises a flat plate heater, such as that described in U.S. patent application Ser. No. 10/282,573, assigned to the assignee of the present invention. Advantageously, the small dimensions of the air passage 64 in the flat plate heater allow robust control of the pulsed air provided to the nozzle 44.

In another aspect of the invention, a method of dispensing liquid material 12 to a substrate 14 comprises dispensing the liquid material 12 from a liquid discharge outlet 50, directing a stream of pressurized air toward the dispensed liquid material 12, and varying the pressure of the pressurized air to create a desired pattern of dispensed liquid material 12. In one embodiment, varying the pressure of the pressurized air comprises pulsing the pressurized air. In another embodiment, pulsing the pressurized air comprises pulsing the air between approximately 500 and 2000 cycles per second.

While the present invention has been illustrated by the description of exemplary embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claim is:

1. An apparatus for dispensing liquid material as an attenuated continuous stream, comprising:

a dispensing module including a liquid supply passage adapted to be in fluid communication with a supply of liquid material, and an air supply passage adapted to be in fluid communication with a source of pressurized air;

a nozzle operatively coupled to said dispensing module and comprising a liquid discharge passage in fluid communication with said liquid supply passage, and an air discharge passage in fluid communication with said air supply passage, said liquid discharge passage having a liquid discharge outlet for discharging the liquid material, said air discharge passage having an air outlet configured to direct the pressurized air generally toward the liquid material discharged from said liquid discharge outlet;

an air valve operatively coupled to said air discharge passage; and a controller coupled with said air valve and operable to actuate said air valve in a manner that pulses the pressurized air discharging from said air outlet as the liquid material is discharged to move the liquid material discharging from said liquid discharge outlet in a desired pattern as the attenuated continuous stream.

2. The apparatus of claim 1, wherein said controller controls the air valve to move the liquid material discharging from said liquid discharge outlet in an oscillating pattern.

3. The apparatus of claim 1, wherein said controller controls said air valve such that the air discharged from said air outlet is pulsed at a rate of approximately 500 cycles per second to approximately 2000 cycles per second.

4. The apparatus of claim 1, wherein said air valve includes an open position and a closed position, and said controller is configured to actuate said air valve between said open and closed positions.

5. The apparatus of claim 1, wherein said air valve includes an open position, a closed position and an intermediate position between said open and closed positions and said controller is configured to actuate said air valve between one of said open and closed positions and said intermediate position.

6. The apparatus of claim 1, further comprising:

a hot air manifold coupled to said dispensing module for heating the pressurized air supplied to said nozzle, said air valve positioned between the source of pressurized air and said nozzle.

7. The apparatus of claim 6, wherein said hot air manifold comprises a flat heater operable to transfer heat to the air supplied to said nozzle.

8. An apparatus for dispensing liquid material, comprising:

a dispensing module including a liquid supply passage adapted to be in fluid communication with a supply of liquid material, and an air supply passage adapted to be in fluid communication with a source of pressurized air;

a nozzle operatively coupled to said dispensing module and comprising first and second liquid discharge passages in fluid communication with said liquid supply passage, and an air discharge passage in fluid communication with said air supply passage, said first and second liquid discharge passages having respective first and second liquid discharge outlets for discharging the liquid material, said air discharge passage having an air outlet positioned between said first and second liquid discharge outlets and configured to direct the pressurized air generally toward the liquid material discharged from said first and second liquid discharge outlets;

an air valve operatively coupled to said air discharge passage, and a controller coupled with said air valve and operable to actuate said air valve in a manner that varies the pressure of the pressurized air discharging from said air outlet as the liquid material is discharged to move the liquid material discharging from said liquid discharge outlets in desired patterns.

9. A method of dispensing liquid material as an attenuated continuous stream from a nozzle having liquid discharge outlet and an air outlet, the method comprising:

dispensing liquid material from the liquid discharge outlet;

discharging a stream of pressurized air from the air outlet toward the dispensing liquid material; and pulsing the pressurized air while dispensing the liquid material to cause the liquid material to move in a desired pattern as the attenuated continuous stream.

10. The method of claim 9, further comprising:

pulsing the pressurized air to cause an oscillating pattern in the discharging liquid material.

11. The method of claim 9, wherein pulsing the pressurized air further comprises pulsing the air at a rate of approximately 500 cycles per second to approximately 2000 cycles per second.

12. A method of dispensing liquid material as an attenuated continuous stream from a nozzle having liquid discharge outlet and an air outlet, the method comprising:

dispensing liquid material from the liquid discharge outlet;

discharging a stream of pressurized air from the air outlet toward the dispensing liquid material; and rapidly varying the pressure of the pressurized air at a periodic rate while dispensing the liquid material to cause the liquid material to move in a desired pattern as the attenuated continuous stream.

* * * * *